US011549656B2

(12) United States Patent
Kappelhoff

(10) Patent No.: US 11,549,656 B2
(45) Date of Patent: Jan. 10, 2023

(54) LIGHTING UNIT FOR A MOTOR VEHICLE, HAVING A REFLECTOR, A CIRCUIT BOARD AND A HEAT SINK

(71) Applicant: Hella GmbH & Co. KGaA, Lippstadt (DE)

(72) Inventor: Martin Kappelhoff, Bad Sassendorf (DE)

(73) Assignee: Hella GmbH & Co. KGaA, Lippstadt (DE)

( * ) Notice: Subject to any disclaimer, the term of this patent is extended or adjusted under 35 U.S.C. 154(b) by 0 days.

(21) Appl. No.: 17/560,407

(22) Filed: Dec. 23, 2021

(65) Prior Publication Data

US 2022/0112997 A1 Apr. 14, 2022

Related U.S. Application Data

(63) Continuation of application No. PCT/EP2020/065761, filed on Jun. 8, 2020.

(30) Foreign Application Priority Data

Jun. 24, 2019 (DE) ..... 10 2019 116 865.1

(51) Int. Cl.
*F21V 7/00* (2006.01)
*F21S 41/39* (2018.01)
(Continued)

(52) U.S. Cl.
CPC ..... *F21S 41/39* (2018.01); *F21S 41/148* (2018.01); *F21S 41/321* (2018.01); *F21S 45/47* (2018.01); *F21S 45/49* (2018.01)

(58) Field of Classification Search
CPC .. F21S 45/47; F21S 45/49; F21S 41/39; F21S 41/192; F21S 41/395; F21S 41/19;
(Continued)

(56) References Cited

U.S. PATENT DOCUMENTS 9,803,825 B2 10/2017 Windgruber
9,829,172 B2 11/2017 Cabanne et al.
(Continued)

FOREIGN PATENT DOCUMENTS

DE 102016120431 A1 4/2018
DE 102017115652 A1 1/2019
(Continued)

OTHER PUBLICATIONS

International Search Report dated Sep. 21, 2020 in corresponding application PCT/EP2020/065761.

*Primary Examiner* — Omar Rojas Cadima
(74) *Attorney, Agent, or Firm* — Muncy, Geissler, Olds & Lowe, P.C.

(57) ABSTRACT

A lighting unit for a motor vehicle, having a reflector, a circuit board with at least one light source, and a heat sink, wherein the circuit board is arranged on the reflector in an assembled state of the lighting unit in such a way that the light source is associated with a reflecting surface of the reflector for directed emission of the light emitted by the light source, and wherein the circuit board can be cooled in the region of the light source via the heat sink in the assembled state of the lighting unit. The circuit board is arranged between the reflector and the heat sink in the assembled state of the lighting unit and is positioned relative to the reflector and the heat sink in a predefined spatial position via the reflector and the heat sink.

13 Claims, 2 Drawing Sheets

(51) Int. Cl.

| | |
|---|---|
| ***F21S 45/49*** | (2018.01) |
| ***F21S 41/148*** | (2018.01) |
| ***F21S 41/32*** | (2018.01) |
| ***F21S 45/47*** | (2018.01) |

(58) Field of Classification Search
CPC ..... F21S 43/19; F21V 17/005; F21V 17/06; F21V 17/16; F21V 17/164; F21V 23/004; F21V 29/70; F21V 29/89
See application file for complete search history.

(56) References Cited

U.S. PATENT DOCUMENTS

| | | | | |
|---|---|---|---|---|
| 9,933,253 | B2 | 4/2018 | Petsch | |
| 2010/0302777 | A1* | 12/2010 | Knoll | F21V 17/06 257/E33.056 |
| 2015/0211843 | A1* | 7/2015 | Petsch | H05K 3/34 29/834 |
| 2015/0338049 | A1* | 11/2015 | Cabanne | F21S 45/49 362/549 |
| 2016/0091164 | A1* | 3/2016 | Mornet | F21S 45/48 362/547 |
| 2017/0248287 | A1* | 8/2017 | Yasuda | F21S 41/148 |

FOREIGN PATENT DOCUMENTS

| | | | |
|---|---|---|---|
| DE | 102017122560 | A1 | 3/2019 |
| WO | WO2014028954 | A1 | 2/2014 |
| WO | WO2014083123 | A1 | 6/2014 |
| WO | WO2014190368 | A1 | 12/2014 |

* cited by examiner

LIGHTING UNIT FOR A MOTOR VEHICLE, HAVING A REFLECTOR, A CIRCUIT BOARD AND A HEAT SINK

This nonprovisional application is a continuation of International Application No. PCT/EP2020/065761, which was filed on Jun. 8, 2020, and which claims priority to German Patent Application No. 10 2019 116 865.1, which was filed in Germany on Jun. 24, 2019, and which are both herein incorporated by reference.

BACKGROUND OF THE INVENTION

Field of the Invention

The present invention relates to a lighting unit for a motor vehicle, comprising a reflector, a circuit board with at least one light source, and a heat sink.

Description of the Background Art

Such lighting units for motor vehicles are already known from the prior art in numerous design versions, and include a reflector, a circuit board with at least one light source, and a heat sink, wherein the circuit board is arranged on the reflector in an assembled state of the lighting unit in such a way that the light source is associated with a reflecting surface of the reflector for directed emission of the light emitted by the light source, and wherein the circuit board can be cooled in the region of the light source via the heat sink in the assembled state of the lighting unit.

SUMMARY OF THE INVENTION

It is therefore an object of the present invention to improve a lighting unit for a motor vehicle, comprising a reflector, a circuit board with at least one light source, and a heat sink.

In an example, this object is attained by a lighting unit, which is characterized in that the circuit board is arranged between the reflector and the heat sink in the assembled state of the lighting unit, and is positioned relative to the reflector and the heat sink in a predefined spatial position via the reflector and the heat sink.

An important advantage of the lighting unit according to the invention is, in particular, that the assembly of the lighting unit, which is to say the conversion of the lighting unit into its assembled state, is improved. Via the invention, a spatial orientation, and thus positioning, of the circuit board with the light source relative to the reflecting surface of the reflector on the one hand, and relative to the heat sink on the other hand, is significantly improved in the assembled state of the lighting unit. The lighting unit with the reflector, the circuit board, and the heat sink is realized in the assembled state of the lighting unit in a sort of sandwich construction in which the circuit board is clamped between the reflector on one side and the heat sink on the other side in the assembled state of the lighting unit, and thus is secured in its spatial position.

The heat sink and the reflector can have mutually corresponding fastener for spatial positioning of the circuit board in the assembled state of the lighting unit. In this way, the spatial positioning of the circuit board in the assembled state of the lighting unit is realized in a structurally especially simple and robust manner.

The mutually corresponding fastener can have at least one pair of mutually corresponding interlocks. As a result, the structural design is simplified further. Moreover, interlocks are simple and robust in use.

The heat sink and the reflector can be joined to one another in the assembled state of the lighting unit via at least one pair of mutually corresponding latches. In this way, the conversion of the lighting unit into its assembled state is simplified still more, and is made possible even without the use of tools, for example.

The pair of mutually corresponding latches can be designed as a spring element and as a spring element receptacle. Latching connections with spring elements permit good tolerance compensation, so that it is possible to reduce the requirements on component tolerances.

The spring element can be designed as a separate component and the spring element receptacle is designed as an integral part of the reflector. As a result, manufacture of the individual components of the lighting unit according to the invention is simplified on the one hand. On the other hand, it is possible to realize a compact design of the lighting unit through the integration of the spring element receptacle into the reflector.

The circuit board, or the circuit board and the heat sink, can have an opening corresponding to the pair of latches. In this way, the compact construction of the lighting unit according to the invention is further improved.

The pair of mutually corresponding fasteners and the pair of mutually corresponding latches are arranged on mutually opposite sides of the heat sink in the assembled state of the lighting unit. As a result, the transmission of force between the reflector and the heat sink is improved significantly.

Another advantageous improvement of the lighting unit according to the invention provides that the reflector and the circuit board and/or the reflector and the heat sink have at least one pair of mutually corresponding positioners. Accordingly, the reflector and the circuit board, or the reflector and the heat sink, or the reflector and the circuit board as well as the reflector and the heat sink can have at least one pair of mutually corresponding positioners. In this way, the spatial positioning of the circuit board relative to the reflector and relative to the heat sink is improved further. For example, a direct referencing of the circuit board to the reflector is made possible by mutually corresponding positioner of the circuit board and reflector. Moreover, a direct referencing of the circuit board and the heat sink to the reflector in each case is made possible in the case of mutually corresponding positioners of the circuit board and the reflector on the one side and mutually corresponding positioners of the reflector and the heat sink on the other side. Accordingly, the tolerance chains are advantageously reduced. Furthermore, a pre-securing during the conversion of the lighting unit according to the invention into its assembled state is made possible by the aforementioned mutually corresponding positioners.

The pair of mutually corresponding positioners of the reflector and the heat sink can be simultaneously designed as the pair of mutually corresponding interlocks. As a result, the structural design of the lighting unit according to the invention is simplified still more. However, it is also possible that the abovementioned positioners are designed at least partially independently of the fasteners designed as interlocks of the reflector and heat sink.

The heat sink can have a projection on a side that faces the circuit board in the assembled state of the lighting unit, wherein the projection is designed and arranged such that the heat sink contacts the circuit board in the region of the light source via the projection in the assembled state of the lighting unit. In this way, it is ensured in a structurally simple manner that the heat sink makes thermally transmissive contact with the circuit board in the region of the light source.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
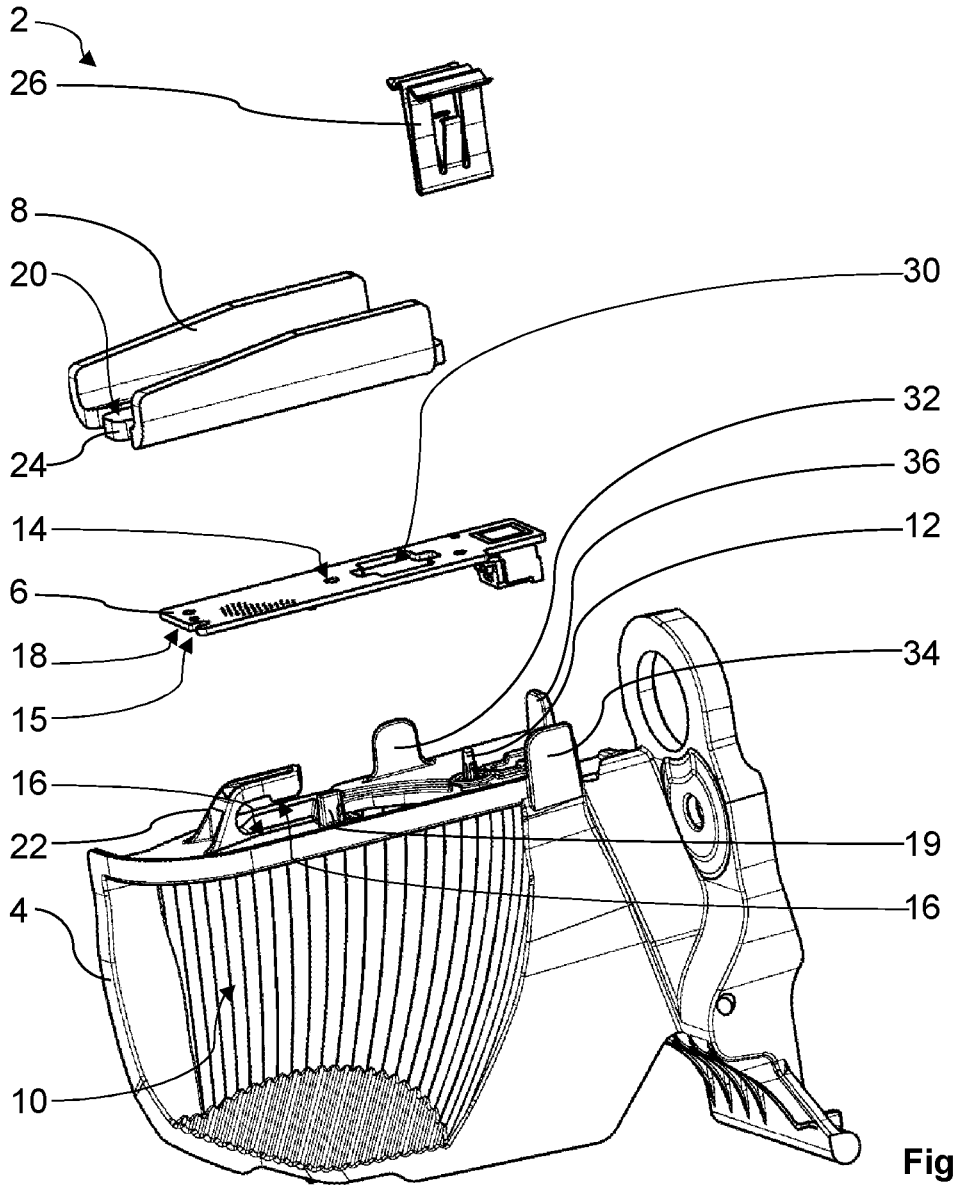
FIG. 1 shows an exemplary embodiment of the lighting unit according to the invention in a perspective, exploded view.
Figure 4:
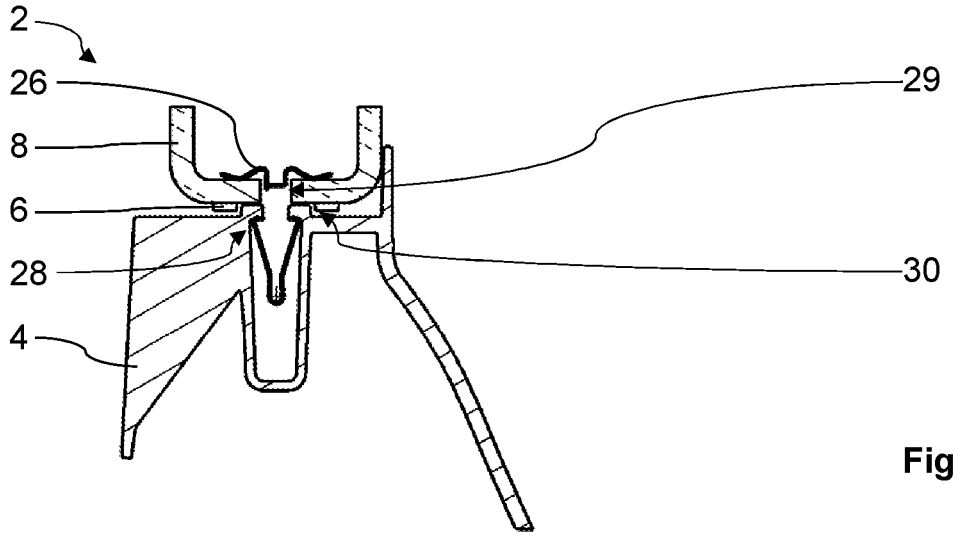
FIG. 4 shows the exemplary embodiment in a cross-sectional view, in the assembled state of the lighting unit, wherein the section line is labeled B-B in FIG. 3.

In FIGS. 1 to 4, an exemplary embodiment of the lighting unit according to the invention is shown by way of example. The lighting unit 2 in the present exemplary embodiment is implemented as a cornering light for a motor vehicle and includes a reflector 4, a circuit board 6 with at least one light source that is not shown, and a heat sink 8. The at least one light source can be implemented as an LED, for example. In an assembled state of the lighting unit 2 shown in FIGS. 2 to 4, the circuit board 6 is arranged on the reflector 4 in such a way that the light source is associated with a reflecting surface 10 of the reflector 4 for directed emission of the light emitted by the light source, wherein the circuit board 6 can be cooled in the region of the light source via the heat sink 8 in the assembled state of the lighting unit 2. In this regard, see FIGS. 2 and 3 in particular, which show the lighting unit 2 in its assembled state.

The materials for the reflector 4, the circuit board 6, and the heat sink 8 can be freely chosen within broad suitable limits. For example, the reflector 4 can be a plastic part, in particular an injection molded plastic part. Plastics are easy to process and allow a multiplicity of designs. The heat sink 8 can be designed as an aluminum body, for example. Aluminum is firstly a good thermal conductor and secondly light.

In the assembled state of the lighting unit 2, the circuit board 6 is arranged between the reflector 4 and the heat sink 8, and is positioned relative to the reflector 4 and the heat sink 8 in a predefined spatial position, which can be seen in FIGS. 1 to 4, via the reflector 4 and the heat sink 8.

For this purpose, the reflector 4 and the circuit board 6 as well as the reflector 4 and the heat sink 8 each have at least one pair of mutually corresponding positioner. Firstly, the reflector 4 has a positioning pin 12 and the circuit board 6 has a positioning opening 14 corresponding to the positioning pin 12. Secondly, the reflector 4 has a multiplicity of positioning surfaces 16, some of which correspond to a positioning surface 18 of the circuit board 6, and others of which correspond to a positioning surface 20 of the heat sink 8. Furthermore, the reflector 4 has a positioning dome 19, and the heat sink 8 has a positioning recess 21 designed to correspond to the positioning dome 19. Additional positioner are explained below.

The positioning surface 16 of the reflector 4 associated with the positioning surface 20 of the heat sink 8 in this case is arranged on an interlocks 22 of the reflector 4 designed as a hook. In this regard see FIG. 1, in particular. In the assembled state of the lighting unit 2, the hook 22 interacts with an interlocks 24—designed as a tab—of the heat sink 8, forming an interlock. The positioning surface 20 of the heat sink 8 is arranged on the side of the tab 24 shown at the top in the plane of the drawing of FIG. 1. The mutually corresponding interlocks 22, 24 of the reflector 4 and of the heat sink 8 are designed for spatially positioning the circuit board 6 in the assembled state of the lighting unit 2, as is explained below in detail.

In addition, the circuit board 6 has a positioning recess 15 that is designed to correspond to the positioning dome 19 of the reflector 4.

The heat sink 8 and the reflector 4 can be joined to one another in the assembled state of the lighting unit 2 via a pair of mutually corresponding latches 26, 28, wherein the mutually corresponding latches 26, 28 are designed as a spring element 26 and as a spring element receptacle 28. In the present exemplary embodiment, the spring element 26 is designed as a separate component, and the spring element receptacle 28 is designed as an integral part of the reflector 4. The spring element 26 is designed as a metal spring, for example. For the purpose of producing the latching connection between the heat sink 8 and the reflector 4, the heat sink 8 has an opening 29. In order to allow the most compact construction possible of the lighting unit 2, the circuit board 6 has an opening 30 corresponding to the pair of latches 26, 28. The openings 29, 30 in this case are dimensioned and arranged such that the spring element 26 projects through the openings 29, 30 in the assembled state of the lighting unit 2 with no force-transmitting connection.

Figure 2:
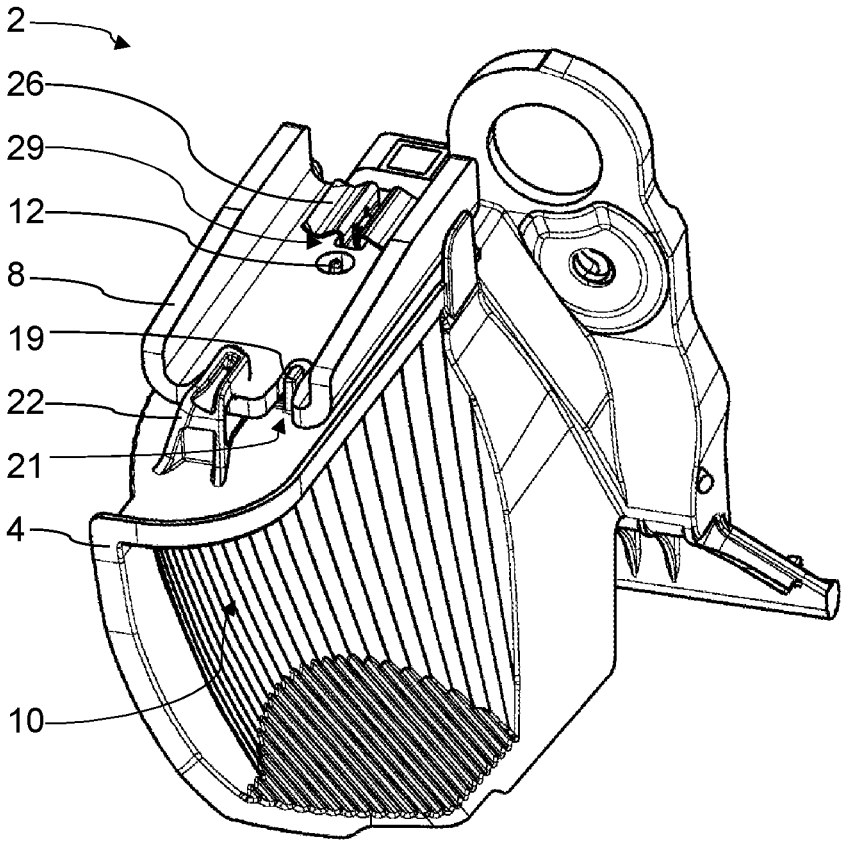
FIG. 2 shows the exemplary embodiment in a perspective view, in the assembled state of the lighting unit.
Figure 3:
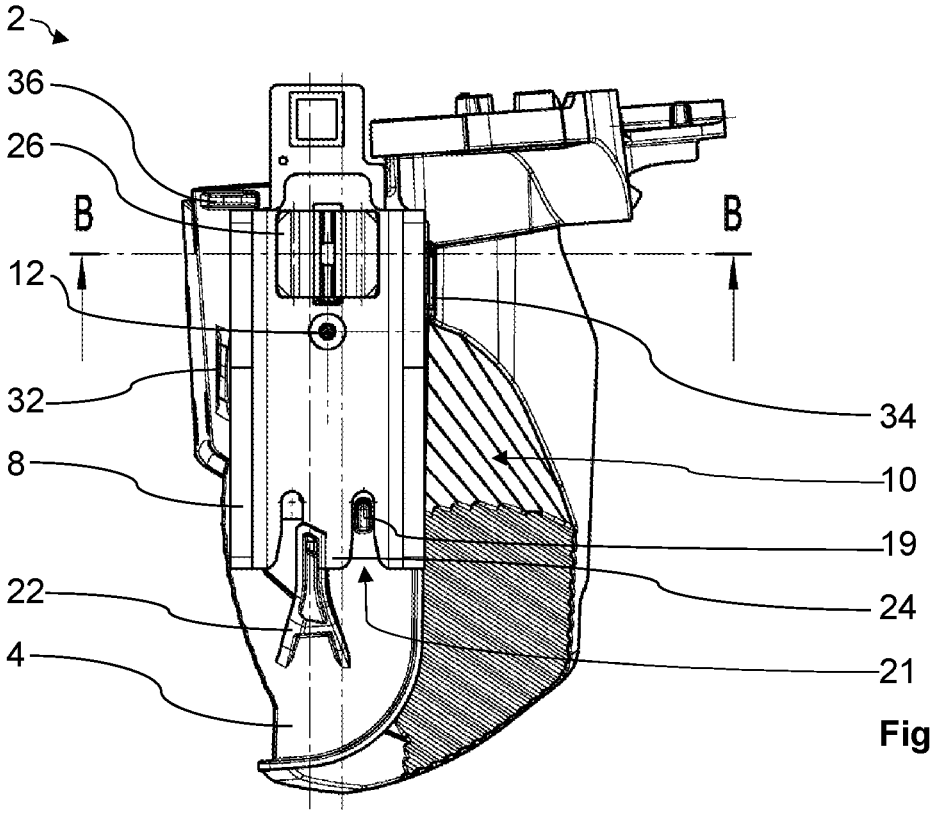
FIG. 3 shows the exemplary embodiment in a top view, in the assembled state of the lighting unit.

As is further evident from FIGS. 1 to 3, the pair of mutually corresponding interlocks 22, 24 and the pair of mutually corresponding latches 26, 28 are arranged on mutually opposite sides of the heat sink 8 in the assembled state of the lighting unit 2.

In order to ensure a good heat-conducting contact between the circuit board 6 in the region of the light source and the heat sink 8, the heat sink 8 has a projection—not shown in FIGS. 1 to 4—on a side that faces the circuit board 6 in the assembled state of the lighting unit 2, wherein the projection is designed and arranged such that the heat sink 8 securely contacts the circuit board 6 in the region of the light source via the projection in the assembled state of the lighting unit 2. The projection can be designed as a stamping of the heat sink 8, for example.

The conversion of the lighting unit according to the invention into its assembled state is explained in detail below in accordance with the present exemplary embodiment on the basis of FIGS. 1 to 4.

Initially, the lighting unit 2 is in a disassembled state shown in FIG. 1. For the purpose of converting the lighting unit 2 from the disassembled state into the assembled state of the lighting unit 2 shown in FIGS. 2 to 4, the circuit board 6 with the at least one light source is first placed on the reflector 4. In this process, on the one hand the positioning opening 14 of the circuit board 6 comes into engagement with the positioning pin 12 of the reflector 4 that corresponds thereto. On the other hand, the positioning opening 15 of the circuit board 6 comes into engagement with the positioning dome 19 of the reflector 4. The circuit board 6 is positioned relative to the reflector 4 in the plane of the drawing of FIG. 3 via the abovementioned positioner of the reflector 4 and of the circuit board 6. Furthermore, the positioning surface 18 of the circuit board 6 placed on the reflector 4 contacts the positioning surface 16 of the reflector 4 that corresponds thereto. In addition to this, an additional positioning surface of the circuit board 6 can also contact an additional positioning surface of the reflector 4 designed to correspond thereto in an analogous manner. In the case of the circuit board 6 placed on the reflector 4, the at least one light source is arranged such that the light source is positioned in a predetermined manner relative to the reflecting surface 10 of the reflector 4 for directed emission of the light emitted by the light source. Via the abovementioned positioner of the reflector 4 and of the circuit board 6, the circuit board 6 is pre-secured relative to the reflector 4.

Subsequently, the heat sink 8 is placed on the reflector 4 with the circuit board 6. For this purpose, the tab 24 of the heat sink 8 is pushed beneath the hook 22 of the reflector 4. In this process, the positioning recess 21 of the heat sink 8 comes into engagement with the positioning dome 19 of the reflector 4, as a result of which the heat sink 8 is positioned in a left/right extent in the plane of the drawing of FIG. 3. The heat sink 8 is now, via the positioning surface 20 arranged on the tab 24 of the heat sink 8, contacting the positioning surface 16 arranged on the hook 22. The heat sink 8 is thus secured on the side of the heat sink 8 facing the hook 22 via the tab 24 and the hook 22 of the reflector 4. In addition, the heat sink 8 is positioned in the plane of the drawing of FIG. 3 via three positioning domes 32, 34, 36. On the one hand, the heat sink 8 is likewise positioned in a left/right extent in the plane of the drawing of FIG. 3 via the positioning domes 32, 34. On the other hand, the heat sink 8 is positioned via the positioning domes 19, 36 in an up/down extent in the plane of the drawing of FIG. 3. After that, the separate spring element 26 is passed through the opening 29 of the heat sink 8 and the opening 30 of the circuit board 6, and enters latching engagement with the spring element receptacle 28 of the reflector 4. Via the spring element 26 and the spring element receptacle 28, the heat sink 8 is secured and thus positioned on the reflector 4 in an up/down extent in the plane of the drawing of FIG. 4. Consequently, the heat sink 8 is connected in a latching manner to the reflector 4 on the side of the heat sink 8 located opposite the hook 22.

As a result, the heat sink 8 is securely connected to the reflector 4 in the assembled state of the lighting unit 2, wherein the circuit board 6 with the at least one light source is arranged between the reflector 4 and the heat sink 8 in the manner of a sandwich construction and is positioned by the reflector 4 and the heat sink 8 in the predefined spatial position relative to the reflector 4 and the heat sink 8.

The invention is not limited to the present exemplary embodiment. For example, the lighting unit for a motor vehicle can be freely chosen within broad suitable limits in terms of type, mode of operation, dimensioning, material, and arrangement. The term "lighting unit" should be interpreted broadly here, and includes both headlights and lamps for motor vehicles. The lighting unit according to the invention can be arranged inside as well as outside on the motor vehicle. Instead of fastener designed as interlocks, the heat sink and the reflector can also be joined to one another via other mutually corresponding fastener.

The at least one pair of latches can likewise be freely chosen within broad suitable limits. For example, it is possible for the two latches of the latches pairing to each be designed as an integral part of the reflector and the heat sink, respectively. Accordingly, it is not strictly necessary for one of the two latches to be designed as a separate latches as is the case in the present exemplary embodiment.

The mutually corresponding positioner of the reflector and of the circuit board and/or of the reflector and of the heat sink need not be designed simultaneously as a fastener. Accordingly, it is possible to separate the positioning function and the fastening function from one another.

Likewise, it is not absolutely necessary for the heat sink to have a projection on the side facing the circuit board in the assembled state of the lighting unit, wherein the projection is designed and arranged such that the heat sink contacts the circuit board in the region of the light source via the projection in the assembled state of the lighting unit. If a projection is provided, it is sufficient if said projection has a height in the range of a few hundredths of a millimeter.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed:

1. A lighting unit for a motor vehicle, the lighting unit comprising:

a reflector;

a circuit board with at least one light source; and a heat sink, wherein the circuit board is arranged on the reflector, in an assembled state of the lighting unit, such that the at least one light source is associated with a reflecting surface of the reflector for directed emission of light emitted by the at least one light source, wherein the circuit board is cooled in a region of the at least one light source via the heat sink in the assembled state of the lighting unit, wherein the circuit board is arranged between the reflector and the heat sink in the assembled state of the lighting unit and is positioned relative to the reflector and the heat sink in a predefined spatial position via the reflector and the heat sink, wherein the reflector and the circuit board have at least one pair of mutually corresponding positioners, wherein a first pair of the at least one pair of mutually corresponding positioners of the reflector and the circuit board include a positioning dome that is inserted into a positioning recess, the reflector having the positioning dome and the circuit board having the positioning recess, and wherein a second pair of the at least one pair of mutually corresponding positioners of the reflector and the circuit board include a positioning pin that is inserted into a positioning opening, the reflector having the positioning pin and the circuit board having the positioning opening.

2. The lighting unit according to claim 1, wherein the heat sink and the reflector have mutually corresponding fasteners for spatial positioning of the circuit board in the assembled state of the lighting unit.

3. The lighting unit according to claim 2, wherein the mutually corresponding fasteners have at least one pair of mutually corresponding interlocks.

4. The lighting unit according to claim 2, wherein the heat sink and the reflector are adapted to be joined to one another in the assembled state of the lighting unit by at least one pair of mutually corresponding latches.

5. The lighting unit according to claim 4, wherein the at least one pair of mutually corresponding latches is designed as a spring element and as a spring element receptacle.

6. The lighting unit according to claim 5, wherein the spring element is designed as a separate component and the spring element receptacle is designed as an integral part of the reflector.

7. The lighting unit according to claim 6, wherein the circuit board and the heat sink each have an opening, the opening of the circuit board and the opening of the heat sink being aligned with the spring element receptacle of the reflector, and wherein a portion of the spring element is inserted through the opening of the heat sink and the opening of the circuit board and is latched into the spring element receptable of the reflector.

8. The lighting unit according to claim 4, wherein the mutually corresponding fasteners and the at least one pair of mutually corresponding latches are arranged on mutually opposite sides of the heat sink in the assembled state of the lighting unit.

9. The lighting unit according to claim 1, wherein the reflector and the heat sink have at least one pair of mutually corresponding positioners.

10. The lighting unit according to claim 9, wherein the at least one pair of mutually corresponding positioners of the reflector and the heat sink are designed as a pair of mutually corresponding interlocks.

11. The lighting unit according to claim 1, wherein the heat sink has a projection on a side that faces the circuit board in the assembled state of the lighting unit, wherein the projection is designed and arranged such that the heat sink contacts the circuit board in the region of the at least one light source via the projection in the assembled state of the lighting unit.

12. A lighting unit for a motor vehicle, the lighting unit comprising:

a reflector;

a circuit board with at least one light source; and a heat sink, wherein the circuit board is arranged on the reflector, in an assembled state of the lighting unit, such that the at least one light source is associated with a reflecting surface of the reflector for directed emission of light emitted by the at least one light source, wherein the circuit board is cooled in a region of the at least one light source via the heat sink in the assembled state of the lighting unit, wherein the circuit board is arranged between the reflector and the heat sink in the assembled state of the lighting unit and is positioned relative to the reflector and the heat sink in a predefined spatial position via the reflector and the heat sink, wherein the reflector and the circuit board have at least one pair of mutually corresponding positioners, wherein the heat sink and the reflector have mutually corresponding fasteners for spatial positioning of the circuit board in the assembled state of the lighting unit, wherein the heat sink and the reflector are adapted to be joined to one another in the assembled state of the lighting unit by at least one pair of mutually corresponding latches, and wherein the circuit board, or the circuit board and the heat sink has/have an opening corresponding to the at least one pair of mutually corresponding latches.

13. A lighting unit for a motor vehicle, the lighting unit comprising:

a reflector;

a circuit board with at least one light source; and a heat sink, wherein the circuit board is arranged on the reflector, in an assembled state of the lighting unit, such that the at least one light source is associated with a reflecting surface of the reflector for directed emission of light emitted by the at least one light source, wherein the circuit board is cooled in a region of the at least one light source via the heat sink in the assembled state of the lighting unit, wherein the circuit board is arranged between the reflector and the heat sink in the assembled state of the lighting unit and is positioned relative to the reflector and the heat sink in a predefined spatial position via the reflector and the heat sink, wherein the reflector and the circuit board have at least one pair of mutually corresponding positioners, wherein a first pair of the at least one pair of mutually corresponding positioners of the reflector and the circuit board include a positioning dome that is inserted into a positioning recess, the reflector having the positioning dome and the circuit board having the positioning recess, and wherein a second positioning recess is provided, the heat sink having the second positioning recess, and wherein the positioning dome of the reflector is inserted into both the positioning recess of the circuit board and the second positioning recess of the heat sink.

* * * * *